US008881333B1

(12) United States Patent
Malakova et al.

(10) Patent No.: US 8,881,333 B1
(45) Date of Patent: Nov. 11, 2014

(54) REPLACEABLE BRISTLE TOOTHBRUSH DEVICE

(71) Applicants: Alevtina Malakova, Forest Hills, NY (US); Boris Fuzaylov, Forest Hills, NY (US)

(72) Inventors: Alevtina Malakova, Forest Hills, NY (US); Boris Fuzaylov, Forest Hills, NY (US)

( * ) Notice: Subject to any disclaimer, the term of this patent is extended or adjusted under 35 U.S.C. 154(b) by 0 days.

(21) Appl. No.: 14/032,412

(22) Filed: Sep. 20, 2013

(51) Int. Cl.
*A46B 7/04* (2006.01)
*A46B 9/04* (2006.01)
*A46B 15/00* (2006.01)

(52) U.S. Cl.
CPC ..... *A46B 9/04* (2013.01); *A46B 15/001* (2013.01); *A46B 15/0038* (2013.01)
USPC ..... 15/167.1; 15/176.4; 15/176.5; 15/184

(58) Field of Classification Search
USPC ..... 15/167.1, 176.4, 176.5, 176.6, 184
See application file for complete search history.

(56) References Cited

U.S. PATENT DOCUMENTS

| | | | | |
|---|---|---|---|---|
| 1,121,082 | A * | 12/1914 | Farrar | 15/194 |
| 2,848,002 | A * | 8/1958 | Hirschfeldt | 132/310 |
| 5,144,712 | A | 9/1992 | Hansel et al. | |
| 5,875,510 | A | 3/1999 | Lamond et al. | |
| 5,901,404 | A | 5/1999 | Lin | |
| 5,984,550 | A | 11/1999 | Chuang | |
| 6,138,316 | A | 10/2000 | Weihrauch | |
| 6,487,748 | B1 | 12/2002 | Dardar et al. | |
| 6,551,265 | B1 | 4/2003 | Miguel | |
| 6,775,875 | B2 | 8/2004 | Omelas et al. | |
| D526,787 | S | 8/2006 | Jandro et al. | |
| 2010/0037408 | A1 | 2/2010 | Brown | |

* cited by examiner

*Primary Examiner* — Randall Chin

(57) ABSTRACT

A replaceable bristle toothbrush device for periodically replacing worn bristles of a toothbrush includes a head having a front face. Each of a plurality of panels has an associated plurality of bristles coupled to and extending from the panel. Each panel is selectively couplable to the front face of the head wherein the associated plurality of bristles extends outwardly from the front face of the head. A handle is provided having a first end and a second end. The head is coupled to and extends from the first end of the handle.

11 Claims, 5 Drawing Sheets

REPLACEABLE BRISTLE TOOTHBRUSH DEVICE

This non-provisional application is a continuation in part of non-provisional application Ser. No. 13/301,895 filed Nov. 22, 2011.

BACKGROUND OF THE DISCLOSURE

Field of the Disclosure

The disclosure relates to toothbrush devices and more particularly pertains to a new toothbrush device for periodically replacing worn bristles of a toothbrush.

SUMMARY OF THE DISCLOSURE

An embodiment of the disclosure meets the needs presented above by generally comprising a head having a front face. Each of a plurality of panels has an associated plurality of bristles coupled to and extending from the panel. Each panel is selectively couplable to the front face of the head wherein the associated plurality of bristles extends outwardly from the front face of the head. A handle is provided having a first end and a second end. The head is coupled to and extends from the first end of the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
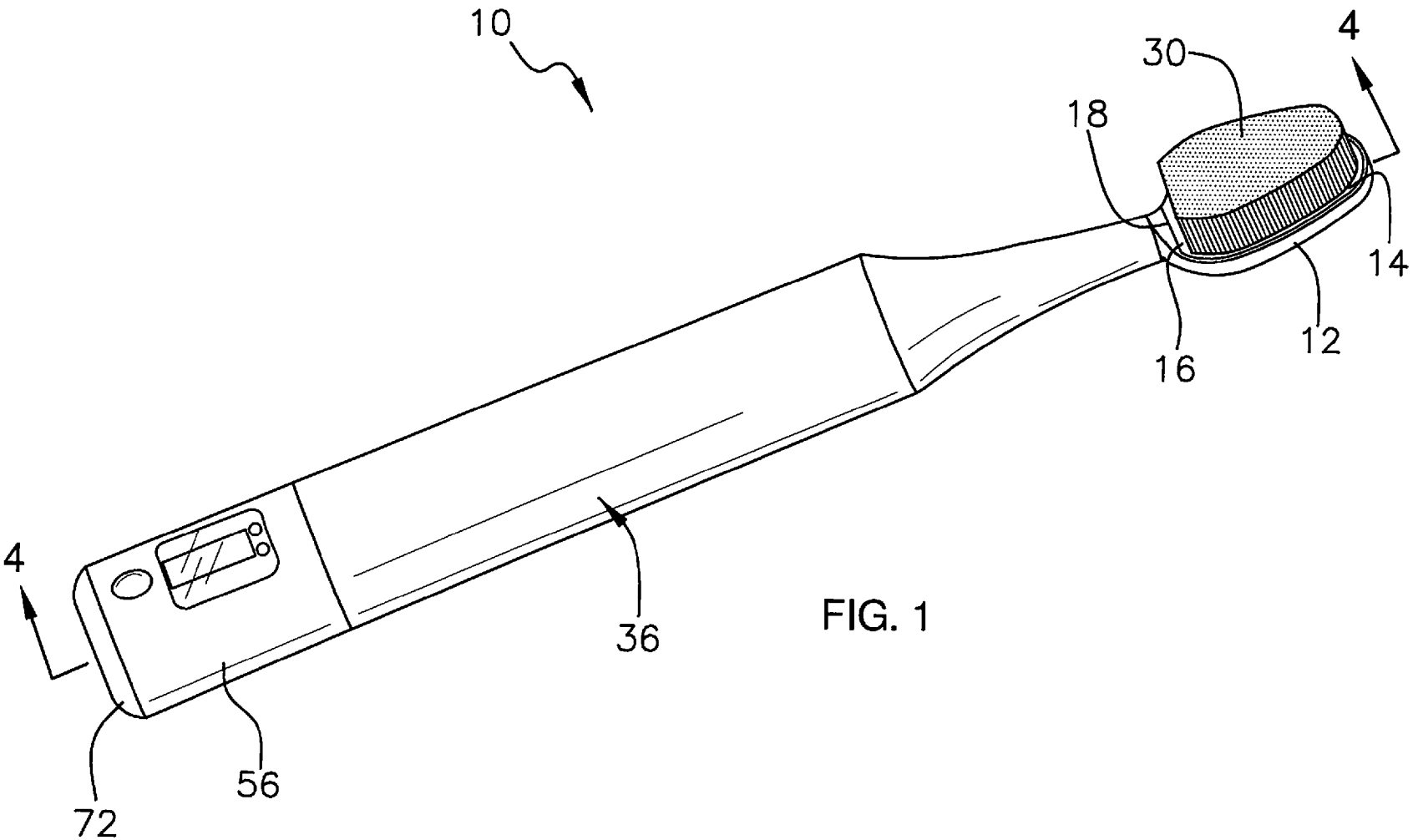
FIG. 1 is a front side perspective view of a replaceable bristle toothbrush device according to an embodiment of the disclosure.
Figure 2:
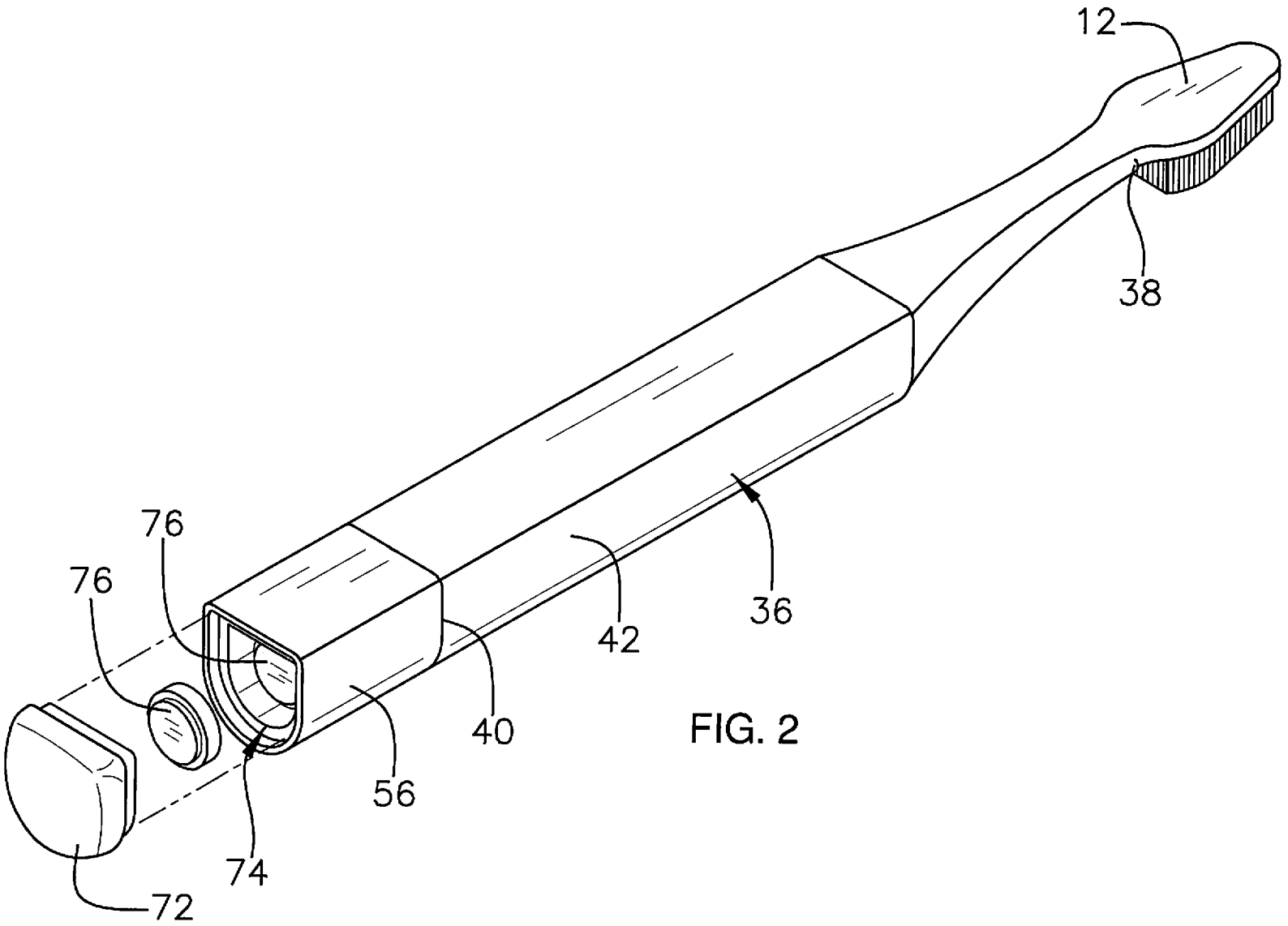
FIG. 2 is a partially exploded bottom back side perspective view of an embodiment of the disclosure.
Figure 3:
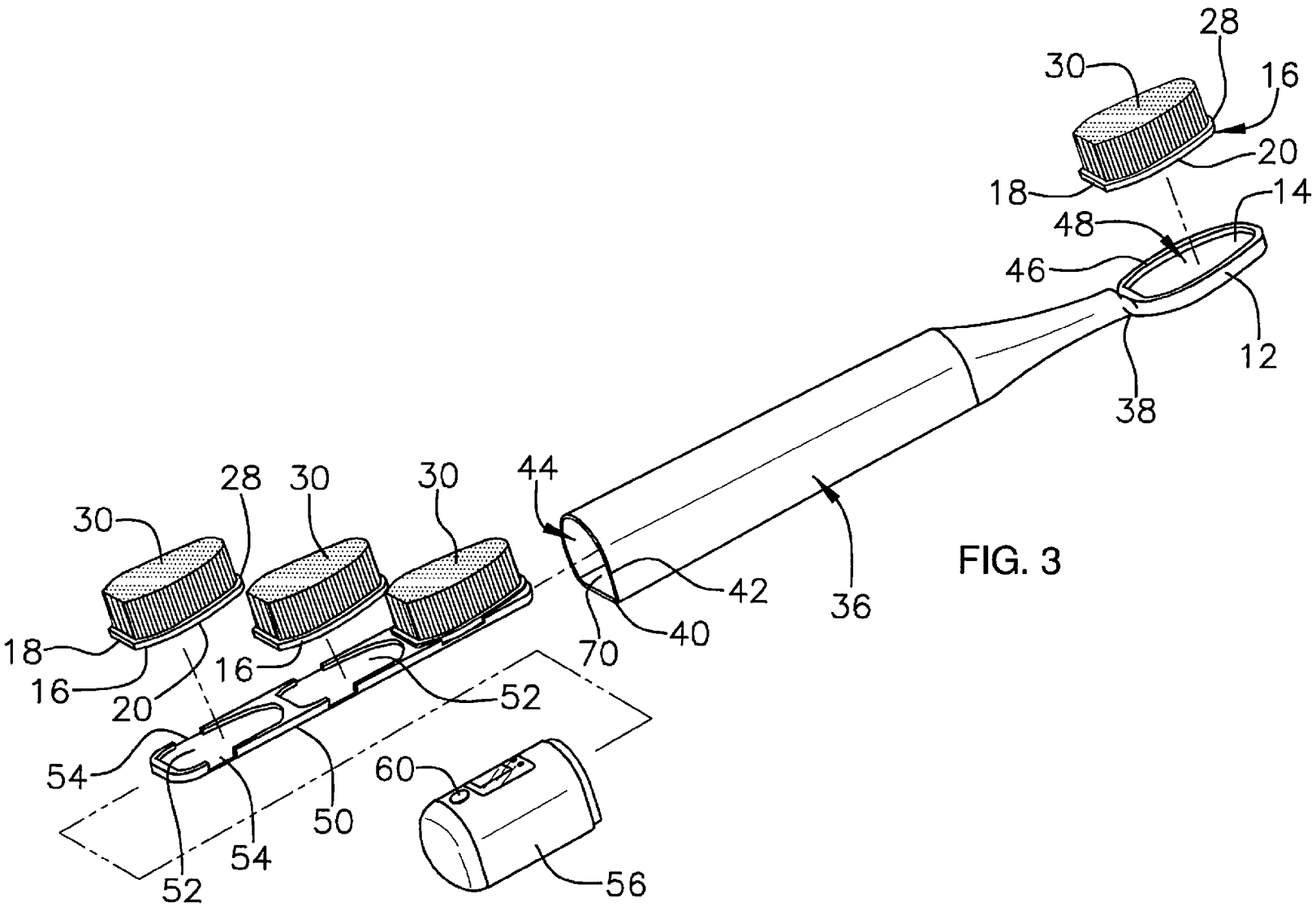
FIG. 3 is a partially exploded bottom front side perspective view of an embodiment of the disclosure.
Figure 4:
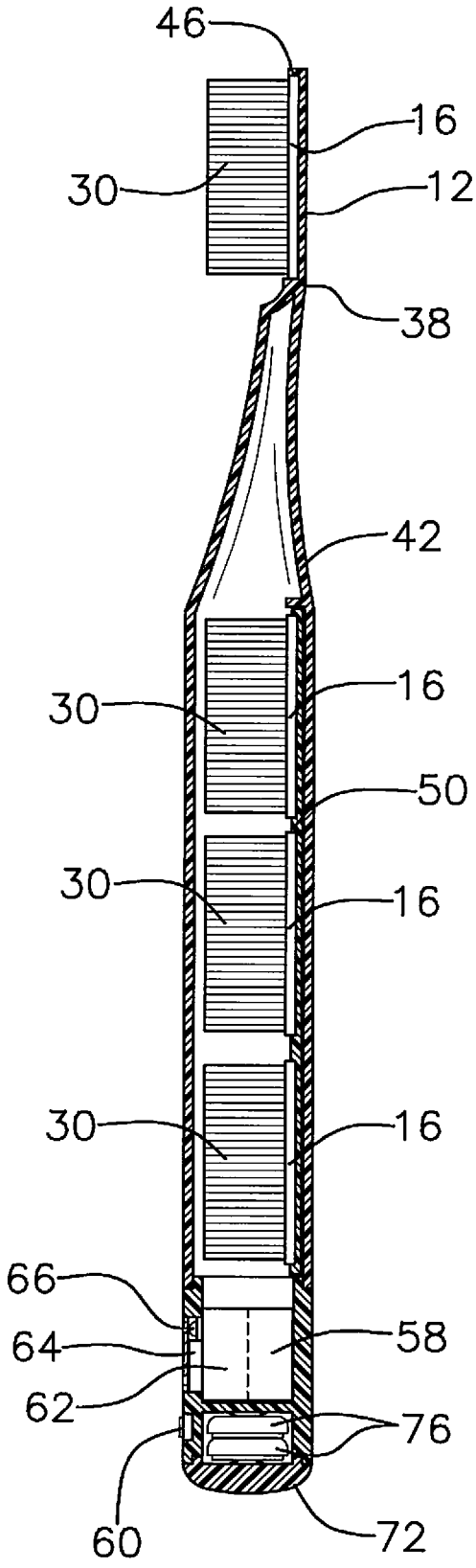
FIG. 4 is a cross-sectional view of an embodiment of the disclosure taken along line 4-4 of FIG. 1.
Figure 5:
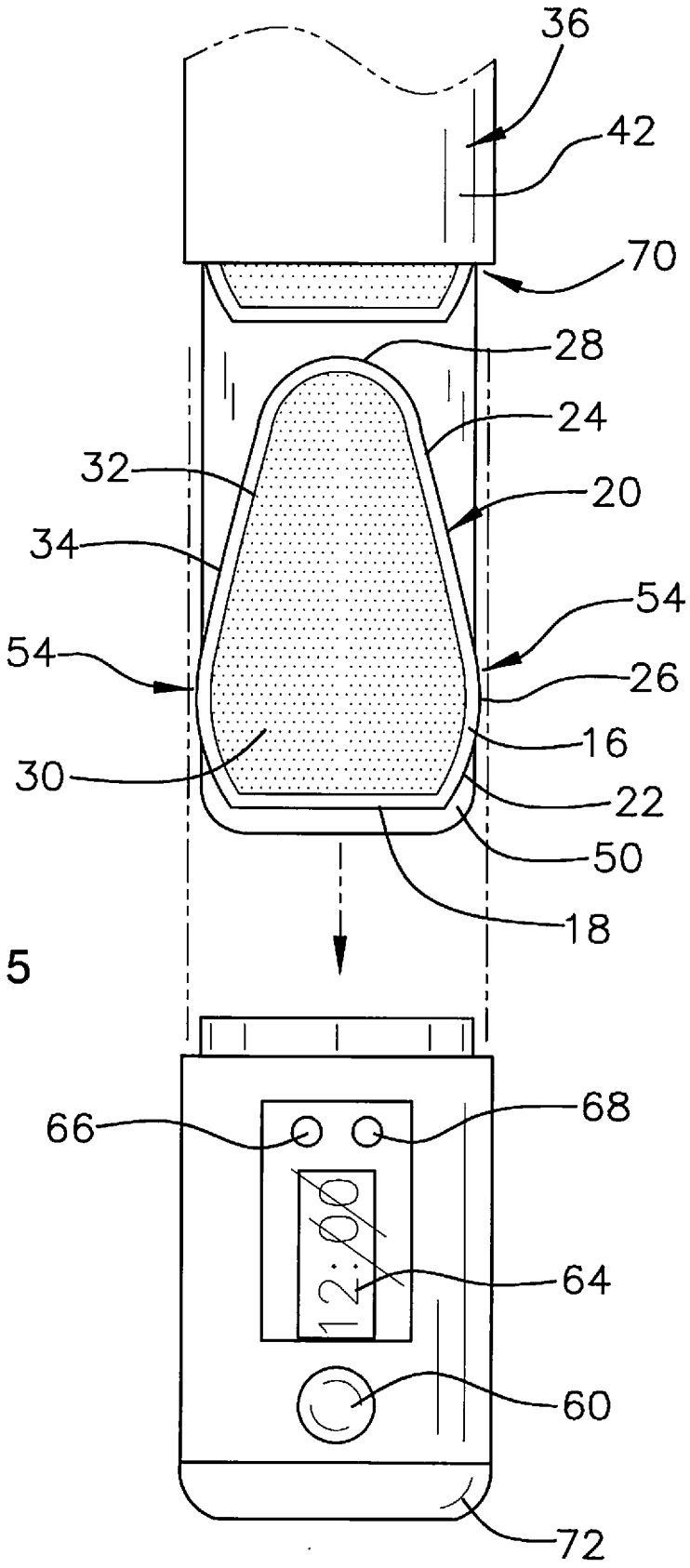
FIG. 5 is a detailed partially exploded partial front view of an embodiment of the disclosure.

With reference now to the drawings, and in particular to FIGS. 1 through 5 thereof, a new toothbrush device embodying the principles and concepts of an embodiment of the disclosure and generally designated by the reference numeral 10 will be described.

As best illustrated in FIGS. 1 through 5, the replaceable bristle toothbrush device 10 generally comprises a head 12 having a front face 14. Each of a plurality of panels 16 has a straight base edge 18 and elongated side edges 20. Each side edge 20 includes a short straight portion 22, a long straight portion 24 and an arcuate medial portion 26. Each panel 16 further has a convex edge 28 extending between the long straight portions 24 of the elongated side edges 20. Each panel 16 has an associated plurality of bristles 30 coupled to and extending from the panel 16. Each panel 16 is selectively couplable to the front face 14 of the head 12 wherein the associated plurality of bristles 30 extends outwardly from the front face 14 of the head 12 in a substantially transverse orientation to the head 12. The bristles 30 of each panel 16 are arranged such that an outer periphery 32 of the associated bristles 30 extends around the panel 16 equidistant from a peripheral edge 34 of the panel 16.

A perimeter wall 46 may extend from the head 12 around the front face 14 of the head 12. The perimeter wall 46 defines a cavity 48 complementary in shape to each panel 16. Each panel 16 is positionable within the cavity 48 such that each panel 16 is inset into the cavity 48 when the panel 16 is coupled to the head 12. Thus, the perimeter wall 46 inhibits lateral movement of the panel 16 relative to the head 12 during use. Each panel 16 may be retained in the cavity 48 by frictional engagement aided by detents, tongues, grooves or the like.

A handle 36 has a first end 38 and a second end 40. The head 12 is coupled to and extends from the first end 38 of the handle 36. The handle 36 comprises a peripheral wall 42 defining an interior space 44 within the handle 36. The second end 40 of the handle 36 defines an opening 70 into the interior space 44. The base edge 18 of each panel 16 is positioned facing the handle 36 when the panel 16 is positioned in the cavity 48. A tray 50 may be provided having a plurality of receivers 52. Each receiver 52 removably couples an associated one of the panels 16 to the tray 50. The tray 50 is positionable within the interior space 44 to store the associated panels 16 within the handle 36 until needed to replace the panel 16 coupled to the head 12. Each receiver 52 may include a pair of opposed slots 54 wherein the associated panel 16 positioned in the receiver 52 is exposed and extends through the slots 54 to facilitate removal of the panel 16.

A cap 56 is selectively couplable to the second end 40 of the handle 36 wherein the opening 42 into the interior space 44 of the handle 36 is selectively closed by coupling the cap 56 to the handle 36. A timer 58 may be positioned in the cap 56 with a control input 60 coupled to the cap 56 and communicatively coupled to the timer 58 wherein the timer 58 is settable to time an effective life of the associated bristles 30 coupled to the panel 16 coupled to the head 12. A processor 62 is coupled to the cap 56 and communicatively coupled to the control input 60 and the timer 58. A display 64 is coupled to the cap 56 and operationally coupled to the processor 62 wherein information is selectively displayable on the display 64 by the processor 62. The information may correspond to remaining effective or recommended life of the bristles 30, a time of day, a duration for suggested brushing, or the like. A selectively removable end piece 72 may be coupled to the cap 56 opposite the handle 36. The end piece 72 provides access to a battery chamber 74 to hold batteries 76 electrically coupled to the processor 62, timer 58, and any other electrically powered elements of the device 10.

A first indicator 66 may be coupled to the cap 56. The first indicator 66 may be incorporated into the display 64 or separate from the display 64. The first indicator 66 is operationally coupled to the processor 62 wherein the processor 62 selectively actuates the first indicator 66 when the panel 16 coupled to the head 12 is to be replaced. Similarly, a second indicator 68 may be coupled to the cap 56 separately or incorporated into the display 64. The second indicator 68 is operationally coupled to the processor 62 wherein the processor 62 selectively actuates the second indicator 68 when each panel 16 originally coupled to the tray 50 has been removed for coupling to the head 12. Thus, the second indicator 68 shows when no panels 16 are available to replace the panel 16 currently coupled to the head 12. Each of the first indicator 66 and the second indicator 68 may be a respective and uniquely colored light illuminated by the processor 62.

In use, an initial panel 16 may be provided coupled to the head 12 with remaining panels 16 coupled to the tray 50 stored in the interior space 44 of the handle 36. The control input 60 may be manipulated to operate the various functions described above or any other similar functions conventionally incorporated into existing toothbrush devices. Upon expiration of the useful or recommended life of the bristles 30 coupled to the head 12, a new panel 16 may be taken from the tray 50 and coupled to the head 12 replacing the used panel 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A replaceable bristle toothbrush device comprising:

a head having a front face;

a plurality of panels, each panel having an associated plurality of bristles coupled to and extending from said panel, each said panel being selectively couplable to said front face of said head wherein said associated plurality of bristles extends outwardly from said front face of said head; and a handle having a first end and a second end, said head being coupled to and extending from said first end of said handle;

said handle comprising a peripheral wall defining an interior space within said handle, said second end of said handle being open defining an opening into said interior space; and a tray having a plurality of receivers, each said receiver removably coupling an associated one of said panels to said tray wherein said tray is positionable within said interior space to store said associated panels within said handle, each receiver comprising a pair of opposed slots wherein said associated panel is exposed through said slots when said associated panel is positioned in said receiver.

2. The device of claim 1, further comprising a perimeter wall extending from said head around said front face of said head, said perimeter wall defining a cavity complementary in shape to each said panel, each said panel being positionable within said cavity such that each said panel is inset into said cavity when said panel is coupled to said head wherein said perimeter wall inhibits lateral movement of said panel relative to said head.

3. The device of claim 1, further comprising a cap selectively couplable to said second end of said handle wherein an opening into said interior space of said handle is selectively closed by coupling said cap to said handle.

4. The device of claim 1, further comprising:

each said panel having a straight base edge, each said panel having elongated side edges comprising a short straight portion, a long straight portion and an arcuate medial portion, each said panel further comprising a convex edge extending between said long straight portions of said elongated side edges, said bristles of each said panel being arranged wherein an outer periphery of said associated bristles extends around said panel equidistant from a peripheral edge of said panel;

a perimeter wall extending from said head around said front face of said head, said perimeter wall defining a cavity complementary in shape to each said panel, each said panel being positionable within said cavity such that each said panel is inset into said cavity when said panel is coupled to said head wherein said perimeter wall inhibits lateral movement of said panel relative to said head, said base edge being positioned facing said handle when said panel is positioned in said cavity;

a cap selectively couplable to said second end of said handle wherein said opening into said interior space of said handle is selectively closed by coupling said cap to said handle;

a timer positioned in said cap;

a control input coupled to said cap and communicatively coupled to said timer wherein said timer is settable to time an effective life of said associated bristles coupled to said panel coupled to said head;

a processor communicatively coupled to said control input and said timer; and a display coupled to said cap, said display being operationally coupled to said processor wherein information is selectively displayable on said display by said processor;

a first indicator coupled to said cap, said first indicator being operationally coupled to said processor wherein said processor selectively actuates said first indicator when said panel coupled to said head is to be replaced;

a second indicator coupled to said cap, said second indicator being operationally coupled to said processor wherein said processor selectively actuates said second indicator when each said panel originally coupled to said tray has been removed for coupling to said head, each of said first indicator and said second indicator being a respective light illuminated by said processor.

5. A replaceable bristle toothbrush device comprising:

a head having a front face;

a plurality of panels, each panel having an associated plurality of bristles coupled to and extending from said panel, each said panel being selectively couplable to said front face of said head wherein said associated plurality of bristles extends outwardly from said front face of said head;

a handle having a first end and a second end, said head being coupled to and extending from said first end of said handle;

a cap selectively couplable to said second end of said handle wherein an opening into said interior space of said handle is selectively closed by coupling said cap to said handle;

a timer positioned in said cap; and a control input coupled to said cap and communicatively coupled to said timer wherein said timer is settable to time an effective life of said associated bristles coupled to said panel coupled to said head.

6. The device of claim 5, further comprising:

a processor communicatively coupled to said control input and said timer; and a display coupled to said cap, said display being operationally coupled to said processor wherein information is selectively displayable on said display by said processor.

7. The device of claim 6, further comprising a first indicator coupled to said cap, said first indicator being operationally coupled to said processor wherein said processor selectively actuates said first indicator when said panel coupled to said head is to be replaced.

8. The device of claim 7, further comprising a second indicator coupled to said cap, said second indicator being operationally coupled to said processor wherein said processor selectively actuates said second indicator when each said panel originally coupled to a tray has been removed for coupling to said head.

9. The device of claim 8, further comprising each of said first indicator and said second indicator being a respective light illuminated by said processor.

10. A replaceable bristle toothbrush device comprising:

a head having a front face;

a plurality of panels, each panel having an associated plurality of bristles coupled to and extending from said panel, each said panel being selectively couplable to said front face of said head wherein said associated plurality of bristles extends outwardly from said front face of said head;

a handle having a first end and a second end, said head being coupled to and extending from said first end of said handle; and each said panel having a straight base edge positioned facing said handle when said panel is positioned in a cavity such that said panel is coupled to said head, each said panel having elongated side edges comprising a short straight portion, a long straight portion and an arcuate medial portion, each said panel further comprising a convex edge extending between said long straight portions of said elongated side edges.

11. The device of claim 10, further comprising said bristles being arranged wherein an outer periphery of said bristles extends around said panel equidistant from a peripheral edge of said panel.

* * * * *